United States Patent [19]

Buttermore et al.

[11] Patent Number: 4,836,875

[45] Date of Patent: Jun. 6, 1989

[54] METHOD OF MAKING AN ELECTRICALLY RESISTIVE SHEET

[75] Inventors: Alun L. Buttermore, Carlsbad; Mark T. Harder, San Diego, both of Calif.

[73] Assignee: The Boeing Company, Seattle, Wash.

[21] Appl. No.: 63,014

[22] Filed: Jun. 17, 1987

Related U.S. Application Data

[63] Continuation-in-part of Ser. No. 839,183, Mar. 13, 1986, abandoned.

[51] Int. Cl.[4] ..... B44C 1/16; B28B 1/26

[52] U.S. Cl. ..... 156/231; 156/241; 156/246; 156/285; 264/87

[58] Field of Search ..... 156/230, 231, 238, 232, 156/246, 247, 249, 289, 297, 239, 240, 285, 298, 241; 264/86, 87, 101, 257; 162/157.1, 157.6, DIG. 1, 157.5

[56] References Cited

U.S. PATENT DOCUMENTS

| | | | |
|---|---|---|---|
| 3,189,503 | 6/1965 | Bergstein et al. | 156/231 |
| 3,671,385 | 6/1972 | Trent | 162/157.1 |
| 3,690,975 | 9/1972 | Groombridge | 156/62.2 |
| 3,935,060 | 1/1976 | Bloome et al. | 264/87 |
| 4,041,116 | 8/1977 | Baud et al. | 264/87 |
| 4,242,163 | 12/1980 | Nakajima et al. | 156/246 |
| 4,314,813 | 2/1982 | Masaki | 156/235 |
| 4,344,804 | 8/1982 | Bijen et al. | 264/257 |
| 4,364,784 | 12/1982 | Van Wersch et al. | 156/231 |
| 4,453,573 | 6/1984 | Thompson | 162/DIG. 1 |
| 4,457,968 | 7/1984 | Harvey | 162/DIG. 1 |
| 4,532,099 | 7/1985 | Kaji | 156/246 |
| 4,632,794 | 12/1986 | Mori et al. | 264/87 |

*Primary Examiner*—Michael W. Ball
*Assistant Examiner*—Louis Falasco
*Attorney, Agent, or Firm*—Finnegan, Henderson, Farabow, Garrett & Dunner

[57] ABSTRACT

A method for making a sheet of resistive material having randomly oriented conductive fibers with a density of approximately 50 to 300 milligrams per square meter. The fibers are weighed, mixed with a solvent, contained in a non-turbulent state. The solvent is withdrawn under pressure through a porous film and backing. A sticky sheet material is placed in contact with the film for transferring the fibers from the film to the sheet.

10 Claims, 3 Drawing Sheets

METHOD OF MAKING AN ELECTRICALLY RESISTIVE SHEET

This application is a continuation-in-part of a U.S. patent application entitled "A METHOD FOR PROVIDING RANDOM FIBER DISPERSION AND IMPREGNATION ON SURFACE APPLICATIONS" bearing Ser. No. 06/839,183 filed Mar. 13, 1986, now abandoned.

BACKGROUND OF THE INVENTION

The present invention relates to a method of making electrically resistive sheets of material; and more particularly, to an improved method of making sheet material having electrically conductive fibers disposed randomly at a selected density for producing a resistive network that has uniform dielectric properties without polarization dependence.

Resistive sheet material is useful in removing precipitated static electricity from aircraft surfaces, such as radomes, for example; and also, in reflecting selected bands of frequencies, while passing other frequencies. The particular characterisics of the sheet material determine the frequency bands that are selected.

An insulative sheet material having small conductive fibers, such as carbon or metal, bonded on one surface thereof, is sometimes used as a resistive sheet. The type of fibers, the length and diameter of the individual fibers, the density of the fibers, and the uniformity of distribution on the surface of the material, all affect the resistivity and characteristics of the material. In order to be effective, however, the sheet material should have uniform resistivity in all directions; and also be able to be manufactured so that the desired characteristics can be repeatedly obtained from one batch of material to another.

Small electrically conductive fibers, such as carbon or metal fibers, when dispersed in a manner where they are free to individually orient themselves, tend to attract each other and align themselves in a particular direction. This alignment produces a resistive sheet material that exhibits polarization dependent electrical characteristics which adversely affects the ability of certain frequencies, particularly microwave, to pass through the material. Further, by their very nature, the uniformity of distribution, and the accuracy of selected densities of small fibers or filaments ($\frac{1}{4}''$ to $\frac{3}{4}''$ in length and eight to twelve microns in diameter) are difficult to control.

Heretofore, in order to minimize the problem of polarization and to control the density of the fibers, a sheet of resistive material was made from a plurality of individual laminated layers the number of which depended on the desired density; and with each sheet oriented relative to the other in order to neutralize polarization dependencies. Also, a known method for overcoming the aforementioned problems involved spraying a solution of an anti-static surface coating containing the fibers directly on the surface of the sheet material. Although, the spraying of the coating/fiber mixture offset the tendency of the fibers to align themselves, it was difficult to control accurately, the density and uniformity of distribution of the fibers, as well as to insure that the fibers were properly bonded to the surface.

SUMMARY OF THE INVENTION

An object of the present invention is to provide an improved method of making a resistive sheet material of conductive fibers that provides for accurate control of selected fiber lengths and densities.

Another object of the present invention is to provide an improved method of making a resistive sheet material wherein the resistivity of the network of conductive fibers is substantially equal in all directions.

A further object of the present invention is to provide an improved method of making a resistive sheet mateial having conductive fibers on a surface thereof that permits the use of different types of fibers and of flexible non-conductive backing materials.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the method of making a resistive sheet of material according to this invention, comprises mixing a predetermined quantity of electrically conductive fibers of a selected length with a predetermined volume of a selected liquid solvent for dispersing and suspending the fibers in a random orientation throughout the volulme of liquid solvent; containing the mixture of randomly oriented dispersed fibers and solvent within a selected area having a permeable release film with a porous backing sheet in communication with and beneath the mixture; applying a pressure differential between the surface of the contained mixture and the porous backing for physically depositing the suspended predetermined quantity of fibers on the surface of the film while simultaneously withdrawing the predetermined volume of liquid solvent through the film and porous backing; removing the porous backing from the release film without effectively disturbing the position of the deposited fibers; placing an insulative sheet of material having a sticky surface in intimate contact with the surface of the film and fibers for transferring the deposited fibers to the sticky surface; and separating the film from the sheet of material.

Preferably, the method includes containing the mixture of solvent and fibers in a non-turbulent state during the removal of the solvent and the depositing of the fibers.

In one aspect, the method includes mixing carbon fibers that are pre-cut to a selected length of about one quarter of an inch to about three quarters of an inch and include individual carbon filaments of from about eight to twelve microns in diameter.

In still another aspect, the quantity of fibers is predetermined by weighing each separate quantity of fiber of a different selected length to obtain a total predetermined quantity of fibers of different lengths, the solvent and fibers are mixed to distribute the different lengths uniformly in the predetermined volume of liquid, and the mixture is contained to have an area and depth selected as a function of the desired density of the fibers on the sheet material.

The accompanying drawings, which are incorporated in and constitute a part of this specification, illustrate one embodiment of the invention and, together with the description serve to explain the principles of the invention.

DESCRIPTION OF THE PREFERRED EMBODIMENT

Figure 1:
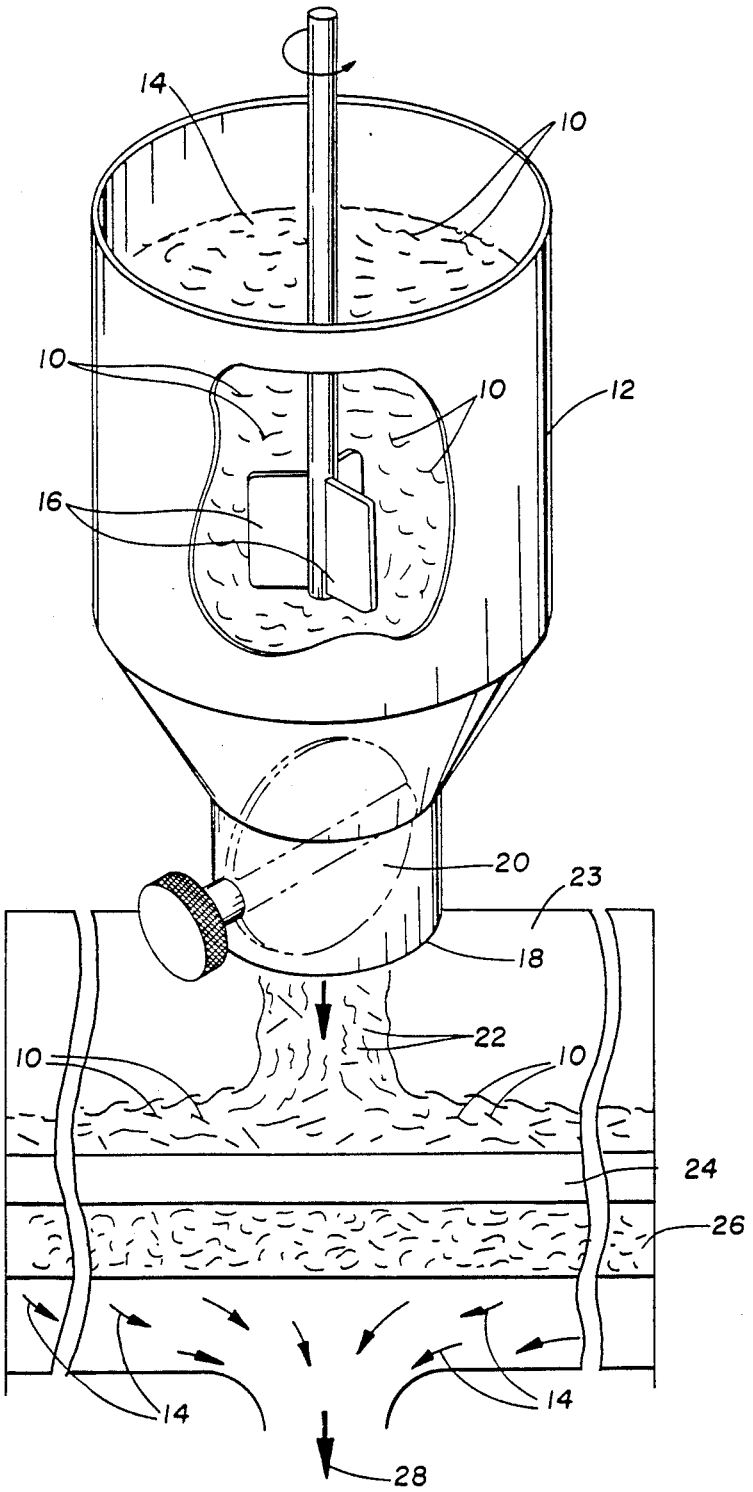
FIG. 1 illustrates schematically the mixing of the solvent and conductive fibers in a mixing tank; the transfer to a containment having a release film with a porous backing, and a vacuum chamber for drawing the solvent through the film and porous backing in accordance with one embodiment of the present invention.

Reference will be made in detail to the present preferred embodiment of the method of the invention, an example of which is illustrated in the accompanying drawings, wherein like reference characters refer to like steps or elements throughout the several figures.

In accordance with the present invention, a method of making a resistive sheet or dielectric material, comprises mixing a predetermined quantity of electrically conductive fibers of a selected length with a predetermined volume of a selected liquid solvent for dispersing and suspending the fibers uniformly in a random orientation throughout the volume of liquid solvent. As embodied herein and referring to FIG. 1, pre-cut conductive fibers, which are preferably carbon or metallic, are referred to as 10. The term fiber and filament as used herein refers to a single thread of carbon or metal having a diameter in the order of 8 to 12 microns in diameter. Fibers 10 are illustrated as being mixed with a liquid solvent 14 in a mixing tank 12. The fibers are dispersed uniformly throughout liquid solvent 14 by mixing blades 16. When the fibers are thoroughly mixed and dispersed; a valve 20 is opended for releasing mixture 22 through a discharge port 18 into a containment or filtration chamber 23.

Carbon fibers 10 are typically in the neighborhood of from one quarter to three quarters of an inch in length; and each individual filament may be anywhere from about eight to twelve microns in diameter. The carbon fibers usually come in bundles of anywhere from 2000 to 6000 fibers per bundle. Each bundle is cut at one time with a conventional chopper. With the present method, fibers of different materials and types, as well as different lengths may be applied to a single sheet as will be appreciated from the description herein. As previously mentioned, metallic, and particularly carbon, filaments have an affinity for each other, and tend to align themselves when placed in a liquid. With the present method, the individual filaments are dispersed and suspended throughout the liquid in three dimensions and then the fibers or filaments are deposited on a two dimensional surface. Thus, the space between fibers 10 in tank 12 while in suspension have less density than is required for a particular characteristic, thus reducing the tendency to attract. Irrespective of the density of the mixture 22, it is preferable that solvent 14 be of the type that is capable of substantially wetting the type of fiber utilized. The solvent tends to break down the alignment of the filaments by neutralizing their attraction for each other which permits the filaments to become suspended randomly in the solution. The type of solvent that is preferably used depends on the type of carbon fiber that is used. For example, a polyamide carbon filament, or a graphite filament, can be suspended in solution and dispersed in a random manner using water or alcohol as the solvent. In actual practice, water was considered preferable because of its high surface tension. Other carbon type materials may be best dispersed in a random manner with solvent, such as acetone, acetate, methyl ethyl ketone, or dichloral methane, for example.

The method includes containing the mixture of randomly oriented dispersed fibers and solvent in a selected area having a permeable release film with a porous backing sheet in communication with and beneath the mixture. As embodied herein and referring to FIG. 1, mixed solution 22 is released into containment 23 where it is permitted to lose its turbulence. As previously mentioned, the neutralization by the chemical and electrical attraction of the filaments by the solvent, which may be at times aided by the low density of the suspended filaments, maintains the filaments in suspension. Containment 23 has a removable bottom that is comprised of a thin release film 24 that has a thick porous backing 26. Release film 24 and backing 26 may be fastened to the walls of containment 23 in any well known conventional manner that will maintain the release film in a flat taut condition. Release film 24 has a permeability that is sufficient to pass the liquid, but will trap the carbon filaments. The material of release film 24 may be a Teflon sheet or any standard type of filter paper for example, depending on the particular requirements. Porous backing 26, may be of any strong porous material sufficient to provide strength and porosity to thin release film 24.

The area of containment bottom 24 and the desired density of filaments 10 determine the total weight of the fibers in the solvent. The volume of the solvent is determined by the total quantity of the fibers. Preferably the volume is selected so that the density of the filaments in solution is at an optimum for aiding the solvent in neutralizing the affinity of the filaments for each other. To obtain optimum results, the volume of solvent selected should be about one liter for each one and one-half milligrams of fiber. Satisfactory results were obtained with a mixture in the range of about one-half milligram to about five milligrams per liter of liquid. The longer the fiber, the greater the amount of liquid is required to maintain separation of the filaments.

The method of the invention also includes applying a pressure differential between the mixture surface and the porous backing for physically depositing the predetermined quantity of fibers dispersed on the surface of the film while simultaneously withdrawing the predetermined volume of liquid solvent downwardly through the release film and porous backing. As embodied herein and referring to FIG. 1, a vacuum is created beneath porous backing 26, which draws solvent 14 downwardly in the direction of solid arrows 14 and arrow 28. The pressure differential must be great enough to empty filtration chamber or containment 23 while filaments 10 are still suspended throughout the solvent. This permits the quantity of filaments to be deposited practically linearly as the depth of the solvent decreases; and thus, provide a uniform density with random orientation of the individual filaments on the surface of release film 24.

Figure 2:
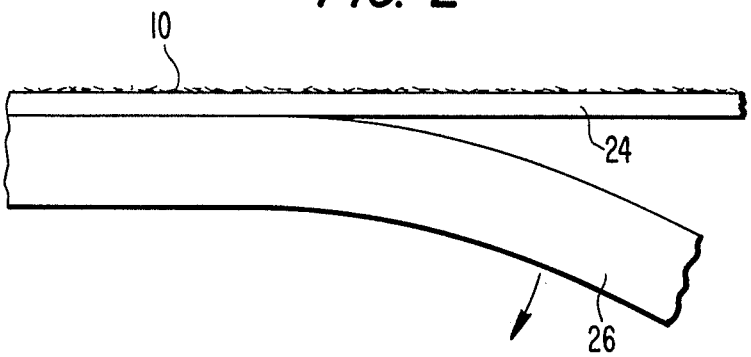
FIG. 2 illustrates schematically the removing of the porous backing from the release film of the present invention.

The method of the present invention further includes removing the porous backing from the release film without effectively disturbing the position of the fibers on the surface of the film. As embodiment herein and referring to FIG. 2, thin film 24 and porous backing 26 are separated by peeling the backing away from the release film. This may be accomplished while the film 24 is still attached to containment 23; or it may be peeled off by maintaining the surface of film 24 which supports fibers 10 in a substantially horizontal position, and peeling off backing 26.

Figure 3:
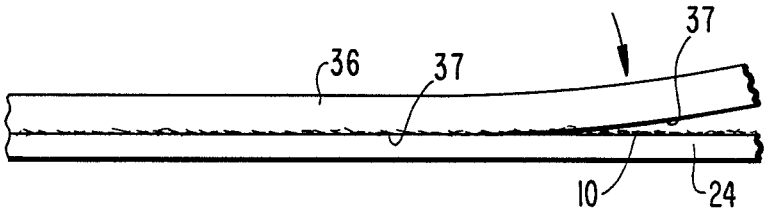
FIG. 3 illustrates schematically the application of the release film to a sticky surface of a piece of sheet material in the method of the present invention.

The method of the present invention also includes placing an insulative sheet of material having a sticky surface in intimate contact with the fiber surface of the film for transferring the deposited fibers to the sticky surface. As embodied herein, and referring to FIG. 3, film 24 is preferably positioned on a flat horizontal surface with fibers 10 exposed. A sheet 36 with a sticky surface 37 is placed in contact with the surface of the film and thus in contact with the network of deposited fibers 10. Depending on the type of sheet material 36 and film 24 that is used, the sheet material may be permitted to cure either prior to or after separating film 24 from sheet 36.

Figure 4:
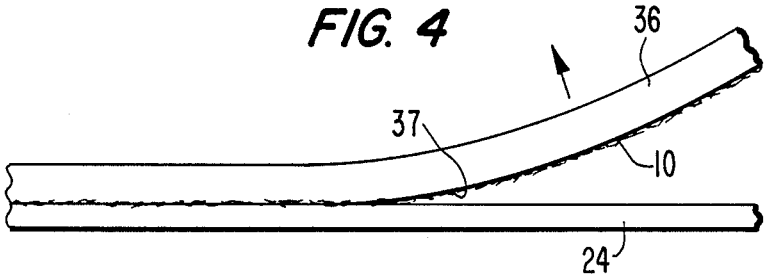
FIG. 4 illustrates schematically the step of removing the release film from the sticky surface of the sheet material in the method of the invention.

As shown in FIG. 4, the pattern of fibers 10 adheres to and is imbedded in the adhesive on sheet 36 when it is removed from film 24. Sheet 36 may be a fiber glass cloth that is impregnated with resin, or one of the well known film adhesives. A film adhesive, such as epoxy, that has been rolled onto a separator film and partially cured to provide some solidification of the material, may be used to form sheet material 36.

Figure 5:
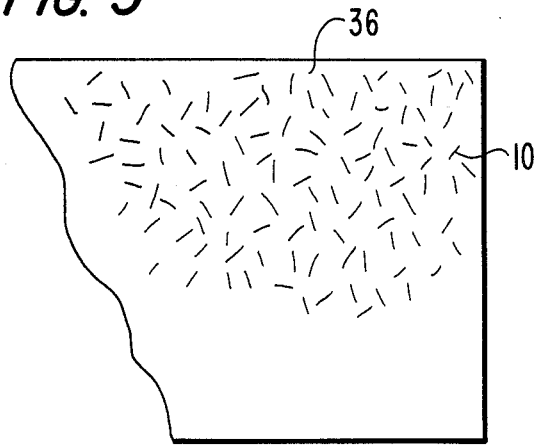
FIG. 5 is a diagrammatic view of a piece of sheet material with carbon filaments of different lengths, dispersed in a random orientation applied by using the method of the present invention.

Sheet material 36 having fibers 10 bonded on a surface thereof is shown in FIG. 5. In actual practice and in accordance with the present method, the quantities of fibers required to be deposited in a randomly oriented manner range from 50 to 300 milligrams per square meter.

Figure 6:
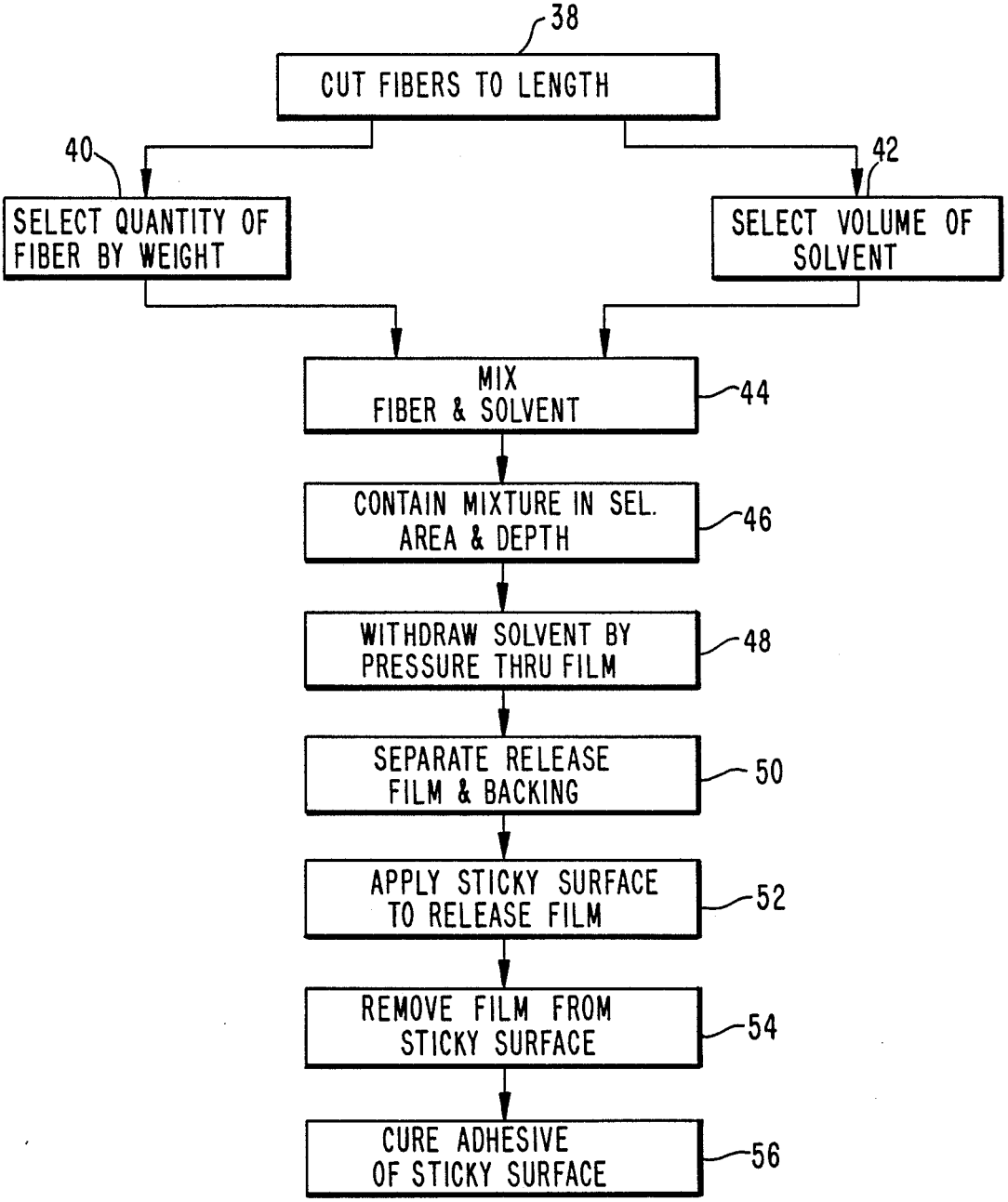
FIG. 6 is a block diagram of the individual steps employed in the method of the present invention.

In summary, and referring to the detailed steps in the block diagram of FIG. 6, the conductive fibers are cut to length as shown at block 38. Then the fiber is weighed and the quantity selected as indicated at block 40 depending on the desired characteristic of the the completed dielectric or resistive sheet and the area of the surface to be covered. The solvent and volume is selected depending on the type and quantity of the fiber, as well as the area of the sheet to be covered as shown at block 42. As indicated at block 44, the fibers and solvent are mixed together thoroughly to disperse the fibers throughout the volume of liquid solvent. This mixture is then contained, such as by transfer to a filter or dewatering chamber, for example, as shown at block 46 so that the mixture can be released over a selected area. Preferably, the mixture should be quiescent to eliminate turbulence and flow patterns, as presiously mentioned. The filtration chamber may be attached to a vacuum table, for example, and the liquid withdrawn downwardly for depositing the fibers on the release film in a random manner, as indicated at block 48. As indicated at block 50, the thin release film is separated from the porous backing; and a film adhesive impregnated fabric is placed in physical contact with the surface of the film holding the randomly dispersed fibers indicated at block 52. The release film is then removed from the sticky surface material indicated at block 54 with the fibers adhering to the surface in the same pattern in which they were deposited on the release film. The material is then cured to dry the adhesive or resin, as the case may be, as indicated at block 56.

From the foregoing description, it becomes readily apparent that the method permits any type of fiber to be randomly dispersed and then applied to a surface or thin adhesive film in precise amounts. The capability for random dispersion is paramount in providing uniform dielectric properties with no polarization dependence. Also, with this method there is the capability of mixing lengths and types of fibers in precise amounts by weighing each constituent and adding it to the mixture. Different lengths, diameters, conductivities, and fiber materials can now be investigated and mixed to provide optimum material properties over a range of frequencies, polarizations, and incidence angles.

Although one preferred embodiment of the method of the present invention has been described in detail, it will be appreciated by those skilled in the art that various modifications and alterations can be made to the particular embodiment shown without materially departing from the novel teachings and advantages of this invention. Accordingly, it is to be understood that all such modifications and alterations are included within the scope of the invention provided they come within the scope of the appended claims and their equivalents.

What we claim is:

1. A method of making an electrically resistive sheet of material having a defined area comprising:

mixing a quantity of electrically conductive fibers of a selected length and having a weight in the range of about 50 to 300 milligrams for each square meter of the defined area with a volume of liquid solvent in the range of one liter for each one-half milligram to about five milligrams of fiber, said solvent and volume being selected for dispersing and suspending the fibers in a random orientation throughout the volume of solvent;

containing the mixture of randomly oriented dispersed and suspended fibers and solvent within a container having a bottom area corresponding to the defined area and having a permeable release film with a porous backing sheet corresponding to and in communication with the bottom area beneath the contained mixture;

permitting the contained mixture to lose turbulence;

applying a pressure differential between the surface of the contained mixture and the porous backing sheet for physically depositing said suspended quantity of fibers on the surface of the film while simultaneously withdrawing said volume of solvent through the film and porous backing;

removing the porous backing from the release film without effectively disturbing the random position of the deposited fibers;

placing an insulative sheet of material having a sticky surface in intimate contact with the surface of the film and deposited fibers for transferring the deposited fibers to the sticky suface; and separating the film from the sticky surface of the insulative sheet material leaving the deposited fibers on the insulated sheet.

2. A method according to claim 1, wherein the conductive fibers are carbon fibers.

3. A method according to claim 1, wherein the carbon fibers are in the range of about one quarter to three quarters of an inch in length and in the range of about eight to twelve microns in diameter.

4. A method according to claim 1, wherein the conductive fibers are carbon fibers and the solvent is water.

5. A method according to claim 4, wherein the carbon fibers are comprised of polyamide.

6. A method according to claim 1, wherein the selected volume of liquid solvent is approximately one liter per one and one-half milligrams of fibers in the mixture.

7. A method according to claim 1, further comprising cutting said fibers to be substantially equal in length prior to mixing in solution.

8. A method according to claim 1, wherein the conductive fibers are carbon.

9. A method according to claim 1, wherein the sheet material is a resin impregnated fabric.

10. A method according to claim 1, wherein the sheet material is an adhesive film.

* * * * *

UNITED STATES PATENT AND TRADEMARK OFFICE

CERTIFICATE OF CORRECTION

PATENT NO. : 4,836,875

DATED : June 6, 1989

INVENTOR(S) : Alun R. Buttermore and Mark T. Harder

It is certified that error appears in the above-identified patent and that said Letters Patent is hereby corrected as shown below:

Column 5, line 12, change "embodiment" to --embodied--.

Column 5, line 63, change "presiously" to --previously--.

Signed and Sealed this

Thirteenth Day of March, 1990

*Attest:*

JEFFREY M. SAMUELS

*Attesting Officer*

*Acting Commissioner of Patents and Trademarks*